US011400469B2

(12) United States Patent
Yang et al.

(10) Patent No.: US 11,400,469 B2
(45) **Date of Patent: *Aug. 2, 2022**

(54) SPRAY TRAY DEVICE CAPABLE OF ROTATABLY SPRAYING DIE LUBRICANT

(71) Applicant: CITIC Dicastal Co., LTD, Qinhuangdao (CN)

(72) Inventors: Jinling Yang, Qinhuangdao (CN); Xiaoting Zhu, Qinhuangdao (CN); Jiansheng Wang, Qinhuangdao (CN); Hongshen Zhang, Qinhuangdao (CN); Weizhou Liu, Qinhuangdao (CN); Li Yang, Qinhuangdao (CN)

(73) Assignee: CITIC DICASTAL CO., LTD, Qinhuangdao (CN)

( * ) Notice: Subject to any disclaimer, the term of this patent is extended or adjusted under 35 U.S.C. 154(b) by 364 days.

This patent is subject to a terminal disclaimer.

(21) Appl. No.: 16/663,340

(22) Filed: Oct. 25, 2019

(65) Prior Publication Data

US 2020/0298258 A1 Sep. 24, 2020

(30) Foreign Application Priority Data

Mar. 21, 2019 (CN) ..... 201910216434.8

(51) Int. Cl.

| | |
|---|---|
| ***B05B 7/08*** | (2006.01) |
| ***B05B 7/04*** | (2006.01) |
| ***B05B 12/02*** | (2006.01) |
| ***B05B 3/02*** | (2006.01) |

(52) U.S. Cl.

CPC ..... *B05B 7/08* (2013.01); *B05B 3/02* (2013.01); *B05B 7/0416* (2013.01); *B05B 7/0892* (2013.01); *B05B 12/02* (2013.01)

(58) Field of Classification Search

CPC ..... B05B 7/0416; B05B 7/045; B05B 7/08; B05B 7/0892; B05B 3/02; B05B 12/02

See application file for complete search history.

(56) References Cited

U.S. PATENT DOCUMENTS

| | | | | |
|---|---|---|---|---|
| 5,065,945 | A * | 11/1991 | Vidusek | B05B 15/65 239/556 |
| 5,603,984 | A * | 2/1997 | Keim | B05B 1/3006 427/133 |
| 6,192,968 | B1 * | 2/2001 | Renkl | B05B 3/1014 164/121 |
| 2017/0304850 | A1 * | 10/2017 | Markus | B05B 7/0483 |
| 2020/0298259 | A1 * | 9/2020 | Yang | B05B 3/02 |

* cited by examiner

*Primary Examiner* — Dah-Wei D. Yuan
*Assistant Examiner* — Stephen A Kitt
(74) *Attorney, Agent, or Firm* — Yong Chen

(57) ABSTRACT

Provided a spray tray device capable of rotatably spraying a die lubricant, wherein a rotating driving mechanism drive the rotating shafts and the spray tray rotators to rotate, and several external nozzles are arranged on the spray tray rotators. The air pipe joints and the lubricant pipe joints respectively input compressed air and a lubricant into cavities, formed between the spray tray rotators and the connection sleeve bodies, through the nozzle connection pipes, and then the compressed air and the lubricant are sprayed out through the external nozzles. The device implements that the same dosage of the lubricant is uniformly sprayed into the surfaces of the maximum pitch circles of upper and lower dies.

10 Claims, 2 Drawing Sheets

SPRAY TRAY DEVICE CAPABLE OF ROTATABLY SPRAYING DIE LUBRICANT

CROSS-REFERENCE TO RELATED APPLICATIONS

The present application claims the priority of Chinese patent application No. 201910216434.8, filed on Mar. 21, 2019, which is hereby incorporated by reference in its entirety.

TECHNICAL FIELD

The present disclosure relates to the technical field of forging equipment, and more particularly relates to a spray tray device capable of rotatably spraying a die lubricant.

BACKGROUND

A forging die of each process is divided into upper and lower dies. During use, it is necessary to spray a lubricant onto the working surfaces of the upper and lower dies to forge a good product. Therefore, whether it is manual production or automated production, each manufacturer sprays the lubricant onto the working surface of the die in a manual way or a stationary way, which is time-consuming, labor-consuming, low in efficiency and low in automation, becomes a bottleneck for the improvement of the efficiency in production and also becomes a factor that affects the production; and furthermore, the lubricant often cannot reach some places on the working surface or is often sprayed non-uniformly, which results in forging production defects. In order to solve the problems that the lubricant cannot reach every place on the working surface of the die and is sprayed non-uniformly, to meet efficient production requirements and to improve the labor productivity, a disk-shaped rotary spray tray device for a forging die lubricant is specially designed, thereby improving the production efficiency of a product and eliminating the forging production defects.

SUMMARY

The embodiment of the present disclosure provides a spray tray device capable of rotatably spraying a die lubricant, which can solve the problems that a lubricant cannot reach every place on the working surface of a die and is sprayed non-uniformly, implement that the same dosage of the lubricant is sprayed to the surfaces of the maximum pitch circles of upper and lower dies and achieve the objective of uniformly spraying the lubricant onto the working surfaces of the upper and lower dies, so that the automation degree of equipment can be increased, the production efficiency is improved, and forging defects are reduced.

In order to achieve the above objectives, the present disclosure provides the following technical solution.

Firstly, a spray tray device capable of rotatably spraying a die lubricant, comprising upper external nozzles, an upper spray tray rotator, an upper connection sleeve body, an upper rotating shaft, an upper rotating driving mechanism, upper air pipe joints, upper lubricant pipe joints, upper nozzle connection pipes, a spray tray main frame, lower external nozzles, a lower spray tray rotator, a lower connection sleeve body, a lower rotating shaft, a lower rotating driving mechanism, lower air pipe joints, lower lubricant pipe joints and lower nozzle connection pipes, wherein the upper spray tray rotator is a circular hollow tube having a top surface, and a first through hole is formed in the middle of the top surface;

a circle of first inner wall is arranged around the first through hole in the upper spray tray rotator, and the upper spray tray rotator is integrally formed; the upper connection sleeve body is fixed to the top surface of the spray tray main frame, and the upper connection sleeve body is a circular hollow tube having a bottom surface; a second through hole is formed in the middle position of the bottom surface of the upper connection sleeve body; the upper spray tray rotator is fastened in the upper connection sleeve body, and the first inner wall is fastened on the circumference of the second through hole; a circular-ring-shaped closed cavity is formed between the upper spray tray rotator and the upper connection sleeve body; the upper external nozzles are arranged on the top surface of the upper spray tray rotator, and the upper external nozzles communicate with the circular-ring-shaped closed cavity formed between the upper spray tray rotator and the upper connection sleeve body; the upper rotating shaft passes through the first through hole in the upper spray tray rotator and the second through hole in the bottom surface of the upper connection sleeve body and is connected to an output shaft of the upper rotating driving mechanism; the upper spray tray rotator is fixed on the upper rotating shaft; the upper spray tray rotator may rotate with the rotation of the upper rotating shaft; the upper rotating driving mechanism is fixed in the spray tray main frame below the upper connection sleeve body; one or more upper nozzle connection pipes are arranged on the spray tray main frame, and the input end of each upper nozzle connection pipe is connected with one upper air pipe joint and one upper lubricant pipe joint, and the output end of each upper nozzle connection pipe communicate with the bottom of the circular-ring-shaped closed cavity formed between the upper spray tray rotator and the upper connection sleeve body; and the lower spray tray rotator is a circular hollow tube having a bottom surface, and a third through hole is formed in the middle of the bottom surface; a circle of second inner wall is arranged around the third through hole in the lower spray tray rotator, and the lower spray tray rotator is integrally formed; the lower connection sleeve body is fixed to the bottom surface of the spray tray main frame, and the lower connection sleeve body is a circular hollow tube having a top surface; a fourth through hole is formed in the middle position of the top surface of the lower connection sleeve body; the lower spray tray rotator is fastened in the lower connection sleeve body, and the second inner wall is fastened on the circumference of the fourth through hole; a circular-ring-shaped closed cavity is formed between the lower spray tray rotator and the lower connection sleeve body; the lower external nozzles are arranged on the bottom surface of the lower spray tray rotator, and the lower external nozzles communicate with the circular-ring-shaped closed cavity formed between the lower spray tray rotator and the lower connection sleeve body; the lower rotating shaft passes through the third through hole in the lower spray tray rotator and the fourth through hole in the top surface of the lower connection sleeve body and is connected to an output shaft of the lower rotating driving mechanism; the lower spray tray rotator is fixed on the lower rotating shaft; the lower spray tray rotator may rotate with the rotation of the lower rotating shaft; the lower rotating driving mechanism is fixed in the spray tray main frame on the lower connection sleeve body; one or more lower nozzle connection pipes are arranged on the spray tray main frame, and the input end of each lower nozzle connection pipe is connected with one lower air pipe joint and one lower lubricant pipe joint, and the output end of the lower nozzle connection pipe communicates with the top of the circular-ring-shaped closed cavity formed between the lower spray tray rotator and the lower connection sleeve body.

In some embodiments, wherein a plurality of cylindrical connection inner walls are further arranged between the top surface of the upper spray tray rotator and the bottom surface of the upper connection sleeve body, and divide the circular-ring-shaped closed cavity between the top surface of the upper spray tray rotator and the bottom surface of the upper connection sleeve body into a plurality of circular-ring-shaped closed cavities; each circular-ring-shaped closed cavity communicates with the outside through the upper external nozzles, and is connected with one upper air pipe joint and one upper lubricant pipe joint through one upper nozzle connection pipe; a plurality of cylindrical connection inner walls are also arranged between the top surface of the lower connection sleeve body and the bottom surface of the lower spray tray rotator, and divide the circular-ring-shaped closed cavity between the top surface of the lower connection sleeve body and the bottom surface of the lower spray tray rotator into a plurality of circular-ring-shaped closed cavities; each circular-ring-shaped closed cavity communicates with the outside through the lower external nozzles, and is connected with one lower air pipe joint and one lower lubricant pipe joint through one lower nozzle connection pipe.

In some embodiments, wherein each of the upper rotating driving mechanism and the lower rotating driving mechanism comprises a servo motor, a speed reducer and a coupling; the servo motors are fixed in the spray tray main frame; output shafts of the servo motors are connected with the speed reducers; outputs of the speed reducers are connected with the couplings; the coupling of the upper rotating driving mechanism is connected with the upper rotating shaft; and the coupling of the lower rotating driving mechanism is connected with the lower rotating shaft.

In some embodiments, wherein the output end of the upper nozzle connection pipe has a horizontal 270-degree circular arc bend, and an output port is arranged on the 270-degree circular arc bend every 90 degrees and communicates with the circular-ring-shaped closed cavity formed between the upper spray tray rotator and the upper connection sleeve body; one internal nozzle is arranged on the output port of each upper nozzle connection pipe on the bottom surface of the upper connection sleeve body; the output end of the lower nozzle connection pipe has a horizontal 270-degree circular arc bend, and an output port is arranged on the 270-degree circular arc bend every 90 degrees and communicates with the circular-ring-shaped closed cavity formed between the lower spray tray rotator and the lower connection sleeve body; and one internal nozzle is also arranged on the output port of each lower nozzle connection pipe on the top surface of the lower connection sleeve body.

In some embodiments, wherein a sealing ring is arranged between the inner side of the side wall of the upper connection sleeve body and the outer side of the side wall of the upper spray tray rotator, and the sealing ring is arranged between the first inner wall and the bottom surface of the upper connection sleeve body; the sealing ring is arranged between the inner side of the side wall of the lower connection sleeve body and the outer side of the side wall of the lower spray tray rotator, and the sealing ring is arranged between the second inner wall and the top surface of the lower connection sleeve body.

In some embodiments, wherein the inner side of the side wall of the upper connection sleeve body is provided with an inward circular-ring step, and the outer side of the side wall of the upper spray tray rotator is provided with an outward circular-ring step; one first bearing is arranged at a mutually fastened position of the step inside the upper connection sleeve body and the step outside the upper spray tray rotator; one second bearing is arranged between the first inner wall and the bottom surface of the upper connection sleeve body, and the second bearing is embedded into the inner side of the first inner wall and arranged on the upper rotating shaft in a sleeving manner; the inner side of the side wall of the lower connection sleeve body is provided with an inward circular-ring step, and the outer side of the side wall of the lower spray tray rotator is provided with an outward circular-ring step; one third bearing is arranged at a mutually fastened position of the step inside the lower connection sleeve body and the step outside the lower spray tray rotator; one fourth bearing is arranged between the second inner wall and the top surface of the lower connection sleeve body, and the fourth bearing is embedded into the inner side of the second inner wall and arranged on the lower rotating shaft in a sleeving manner.

In some embodiments, wherein the upper external nozzles are arranged on the upper spray tray rotator; every four of the upper external nozzles are distributed on one pitch circle, and all the upper external nozzles are distributed on three pitch circles; the lower external nozzles are arranged on the lower spray tray rotator; every four of the lower external nozzles are distributed on one pitch circle, and all the lower external nozzles are distributed on three pitch circles; the outer sides of the center holes of the upper external nozzles and the lower external nozzles are conical, which facilitates the uniformity of lubricant spraying.

In some embodiments, wherein one flange is fixed at each of the top end of the upper rotating shaft and the bottom end of the lower rotating shaft; the flange on the top surface is fixed on the upper spray tray rotator, and the flange on the bottom surface is fixed on the lower spray tray rotator.

In some embodiments, wherein the spray tray main frame comprises a main frame body and a main connection body; the main frame body is located between the upper connection sleeve body and the lower connection sleeve body; upper nozzle connection pipes and lower nozzle connection pipes are fixed on the main frame body; the main connection body horizontally passes through the main frame body from the middle part; the main connection body is of a hollow tubular structure; the upper rotating driving mechanism and the lower rotating driving mechanism are fixed in a hollow cavity of the main connection body; and the output ends of the upper rotating driving mechanism and the lower rotating driving mechanism respectively pass through a through hole in the main connection body and are connected to the upper rotating shaft and the lower rotating shaft.

In some embodiments, wherein the upper air pipe joints and the lower air pipe joints are connected to a compressed air valve body control pipeline; the upper lubricant pipe joints and the lower lubricant pipe joints are connected to a lubricant valve body control pipeline; the device also comprises a control unit; the control unit is connected with pipeline valve bodies of the compressed air valve body control pipeline and the lubricant valve body control pipeline and the servo motors in the upper rotating driving mechanism and the lower rotating driving mechanism in a signal manner; the control unit controls the flow rates, the flow velocities and the pressures of the compressed air and the lubricant by controlling the pipeline valve bodies, and controls the rotating speed and rotating time by controlling the servo motors, so as to control the amount of the lubricant sprayed to the surface of the die.

Compared with the prior art, the present disclosure has the following beneficial effects.

The present disclosure provides the spray tray device capable of rotatably spraying the die lubricant, including the external nozzles, the spray tray rotators, the connection sleeve bodies, the rotating shafts, the rotating driving mechanisms, the air pipe joints, the lubricant pipe joints and the nozzle connection pipes. The rotating driving mechanisms drive the rotating shafts to rotate. The rotating shafts drive the spray tray rotators to rotate. The external nozzles are arranged on the spray tray rotators. The air pipe joints and the lubricant pipe joints respectively input the compressed air and the lubricant into the cavities, formed between the spray tray rotators and the connection sleeve bodies, through the nozzle connection pipes, and then the compressed air and the lubricant are sprayed out through the external nozzles. The device implements that the same dosage of the lubricant is sprayed into the surfaces of the maximum pitch circles of the upper and lower dies and achieves the objective of uniformly spraying the forging lubricant onto the working surfaces of the upper and lower dies to reduce the forging defects. In addition, the control unit of the device controls the flow rates, the flow velocities and the pressures of the compressed air and the lubricant by controlling the pipeline valve bodies, and controls the rotating speed and rotating time by controlling the servo motors, so as to control the amount of the lubricant sprayed to the surface of the die, so that the automation degree of the equipment can be increased, and the production efficiency can be improved.

BRIEF DESCRIPTION OF THE DRAWINGS

In order to more clearly explain the technical solution in the embodiments of the application, drawings which require to be used in description of the embodiments are simply introduced below, obviously, the drawings in description below are some embodiments of the application, and those having ordinary skill in the art can further acquire other drawings without creative efforts according to those drawings.

Figure 1:
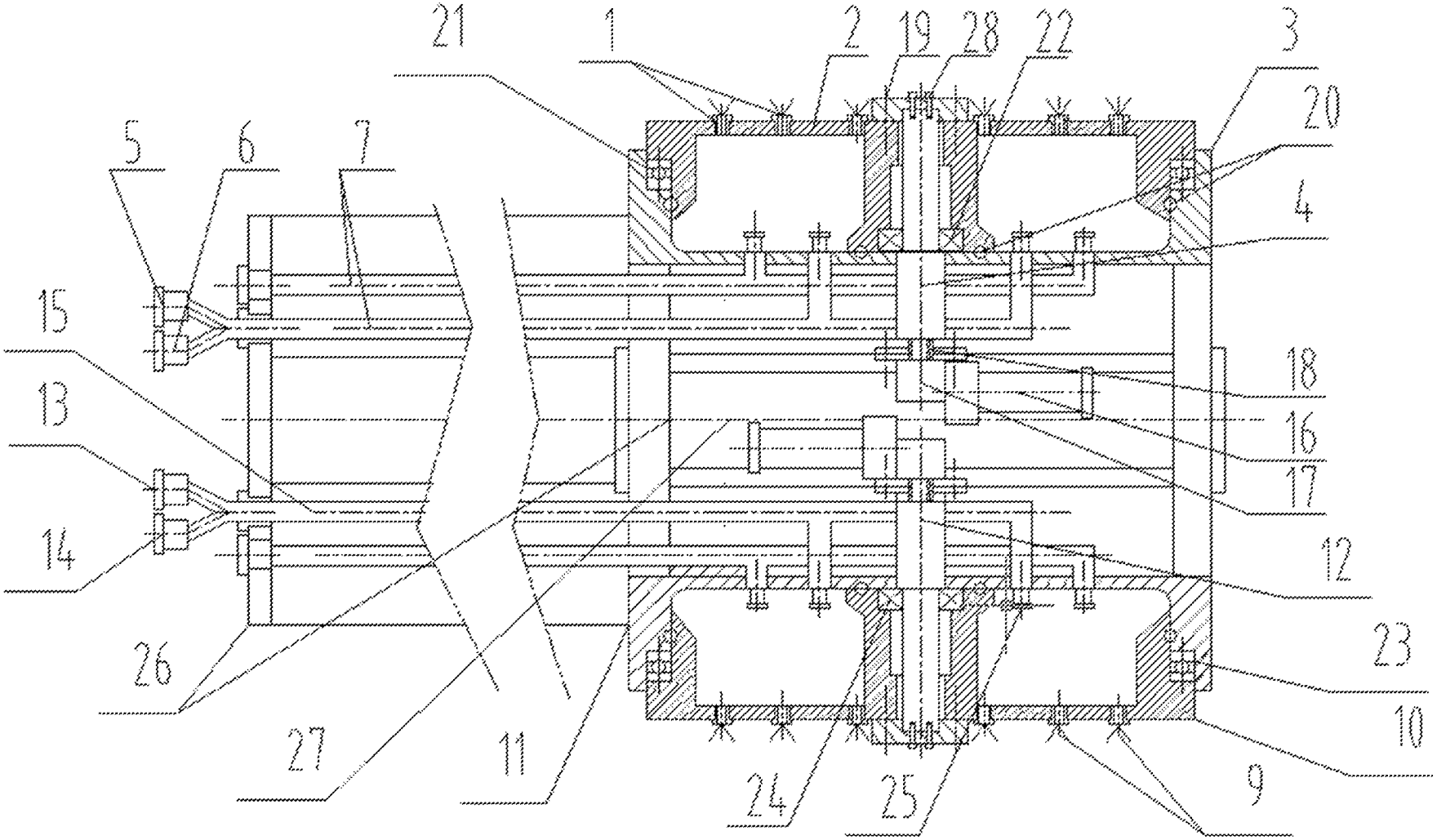
FIG. 1 is a structural schematic diagram of a spray tray device capable of rotatably spraying a die lubricant.

In the drawings: 1: upper external nozzle; 2: upper spray tray rotator; 3: upper connection sleeve body; 4: upper rotating shaft; 5: upper air pipe joint; 6: upper lubricant pipe joint; 7: upper nozzle connection pipe; 8: spray tray main frame; 9: lower external nozzle; 10: lower spray tray rotator; 11: lower connection sleeve body; 12: lower rotating shaft; 13: lower air pipe joint; 14: lower lubricant pipe joint; 15: lower nozzle connection pipe; 16: servo motor; 17: speed reducer; 18: coupling; 19: flange; 20: sealing ring; 21: first bearing; 22: second bearing; 23: third bearing; 24: fourth bearing; 25: internal nozzle; 26: main frame body; 27: main connection body; and 28: connection bolt.

DETAILED DESCRIPTION

The technical solution in the embodiments of the application is clearly and completely described in combination with drawings of the embodiments of the application below, and obviously, the described embodiments are part of embodiments of the application rather than all embodiments. Based on the embodiments of the application, all the other embodiments obtained by those having ordinary skill in the art without any creative works are within the protection scope of the application.

The terms 'first', 'second', 'third', 'fourth' and the like in the specification and in the claims of the application are used for distinguishing different objects but not for describing a specific sequence. Furthermore, the terms 'comprise' and 'have' as well as their any variations are intended to cover a non-exclusive inclusion. For example, a process, method, system, product or equipment comprising a series of steps or units does not limit steps or units which have been listed, but selectively further comprises steps or units which are not listed, or selectively further comprises other inherent steps or units for the process, method, product or equipment.

Reference in the specification to 'embodiments' of the application means that a particular feature, structure or characteristic described in connection with the embodiments is included in at least one embodiment of the application. The appearances of the phrase 'the embodiments' in various places in the specification are not necessarily all referring to the same embodiment, nor are separate or alternative embodiments necessarily mutually exclusive of other embodiments. It will be explicitly and implicitly understood by those skilled in the art that the embodiments described in the application can be combined to other embodiments.

In order to further understand the content, features and functions of the disclosure, the following embodiments are given and illustrated with the attached drawings as follows.

Embodiment 1

Figure 2:
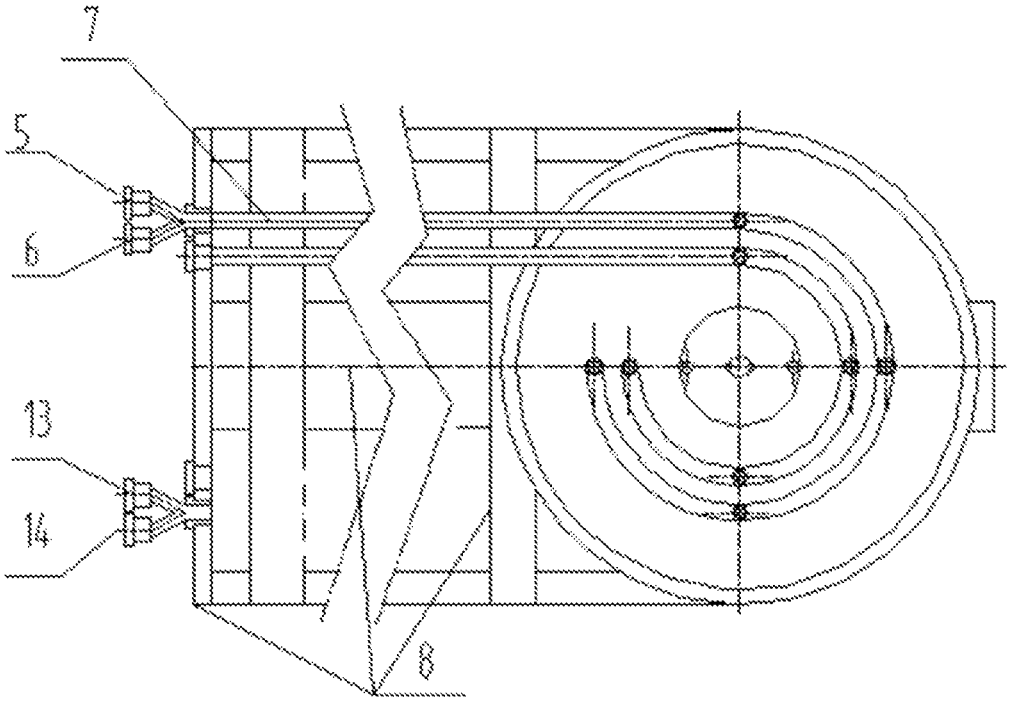
FIG. 2 is a schematic diagram of an upper pipeline of a spray tray device capable of rotatably spraying a die lubricant.
Figure 3:
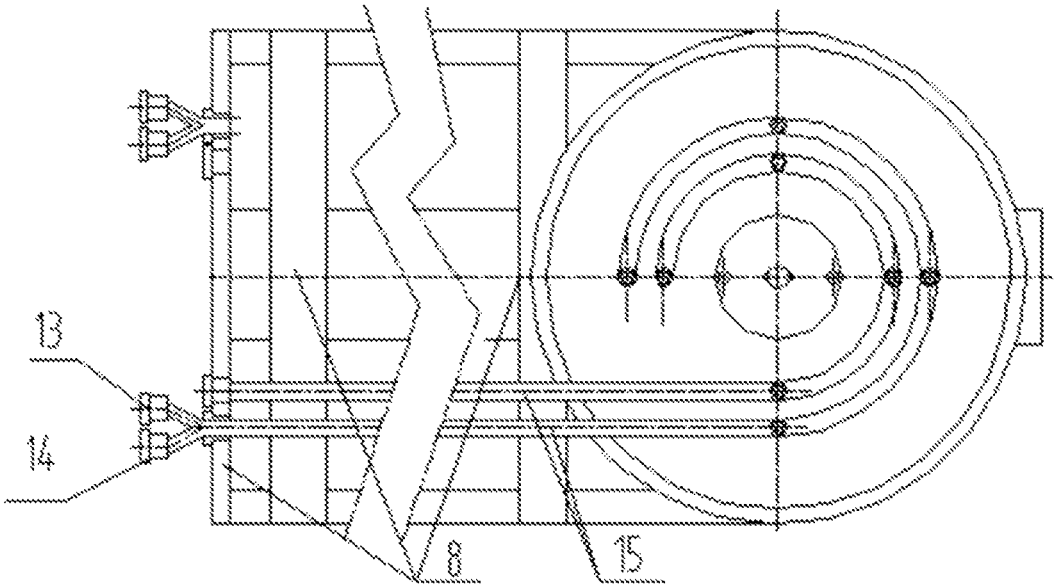
FIG. 3 is a schematic diagram of a lower pipeline of a spray tray device capable of rotatably spraying a die lubricant.

Embodiment 1 of the present disclosure is described below in combination with FIGS. 1 to 3.

A spray tray device capable of rotatably spraying a die lubricant includes upper external nozzles 1, an upper spray tray rotator 2, an upper connection sleeve body 3, an upper rotating shaft 4, an upper rotating driving mechanism, upper air pipe joints 5, upper lubricant pipe joints 6, upper nozzle connection pipes 7, a spray tray main frame 8, lower external nozzles 9, a lower spray tray rotator 10, a lower connection sleeve body 11, a lower rotating shaft 12, a lower rotating driving mechanism, lower air pipe joints 13, lower lubricant pipe joints 14, lower nozzle connection pipes 15, flanges 19, sealing rings 20, a first bearing 21, a second bearing 22, a third bearing 23, a fourth bearing 24, internal nozzles 25, a main frame body 26, a main connection body 27 and connection bolts 28.

The spray tray main frame 8 includes the main frame body 26 and the main connection body 27. The main frame body 26 is located between the upper connection sleeve body 3 and the lower connection sleeve body 11. The main connection body 27 horizontally passes through the main frame body 26 from the middle part. The main connection body 27 is of a hollow tubular structure, and the main frame body 26 and the main connection body 27 are of an integrally welded structure. The upper spray tray rotator 2 is a circular hollow tube having a top surface, and a first through hole is formed in the middle of the top surface. A circle of first inner wall is arranged around the first through hole in the upper spray tray rotator 2, and the upper spray tray rotator 2 is integrally formed. The upper connection sleeve body 3 is fixed to the top surface of the spray tray main frame 8 by welding, and the upper connection sleeve body 3 is a circular hollow tube having a bottom surface. A second through hole is formed in the middle position of the bottom surface of the upper connection sleeve body. The upper spray tray rotator 2 is fastened in the upper connection sleeve body 3, and the first inner wall is fastened on the circumference of the second through hole. A circular-ring-shaped closed cavity is formed between the upper spray tray rotator 2 and the upper connection sleeve body 3. The sealing ring 20 is arranged between the inner side of the side wall of the upper connection sleeve body 3 and the outer side of the side wall of the upper spray tray rotator 2, and the sealing ring 20 is arranged between the first inner wall and the bottom surface of the upper connection sleeve body 3. The inner side of the side wall of the upper connection sleeve body 3 is provided with an inward circular-ring step, and the outer side of the side wall of the upper spray tray rotator 2 is provided with an outward circular-ring step. One first bearing 21 is arranged at a mutually fastened position of the step inside the upper connection sleeve body 3 and the step outside the upper spray tray rotator 2. One second bearing 22 is arranged between the first inner wall and the bottom surface of the upper connection sleeve body, and the second bearing 22 is embedded into the inner side of the first inner wall and arranged on the upper rotating shaft 4 in a sleeving manner. The upper external nozzles 1 are fixedly arranged on the top surface of the upper spray tray rotator 2 by welding, and the upper external nozzles 1 communicate with the circular-ring-shaped closed cavity formed between the upper spray tray rotator 2 and the upper connection sleeve body 3. The upper external nozzles 1 are arranged on the upper spray tray rotator 2. Every four of the upper external nozzles are distributed on one pitch circle, and all the upper external nozzles are distributed on three pitch circles. There are 12 upper external nozzles 1. The outer sides of center holes of the upper external nozzles 1 are conical, which facilitates the uniformity of lubricant spraying. The upper rotating shaft 4 passes through the first through hole in the upper spray tray rotator 2 and the second through hole in the bottom surface of the upper connection sleeve body 3 and is connected to an output shaft of the upper rotating driving mechanism. The upper spray tray rotator 2 is fixed on the upper rotating shaft 4. One flange 19 is fixed at the top end of the upper rotating shaft 4, and the flange 19 on the top surface is fixed to the upper spray tray rotator 2 through the connection bolt 28. The flange 19 integrally connects the upper rotating shaft 4 with the upper spray tray rotator 2 into a whole for rotation through the connection bolt 28. The upper spray tray rotator 2 may rotate with the rotation of the upper rotating shaft 4. The upper rotating driving mechanism is fixed in a hollow cavity of the main connection body 27 of the spray tray main frame 8 below the upper connection sleeve body 3. The upper rotating driving mechanism includes a servo motor 16, a speed reducer 17 and a coupling 18. An output shaft of the servo motor 16 is connected to the speed reducer 17. The output end of the speed reducer 17 is connected to the coupling 18, and the output end of the coupling 18 of the upper rotating driving mechanism passes through the through hole in the main connection body 27 and is connected to the upper rotating shaft 4. Two upper nozzle connection pipes 7 are arranged on the spray tray main frame 8. The upper nozzle connection pipes 7 are fixed on the main body frame 26 by welding. The input end of each upper nozzle connection pipe 7 is connected to one upper air pipe joint 5 and one upper lubricant pipe joint 6, and the output end of the upper nozzle connection pipe 7 communicates to the bottom of the circular-ring-shaped closed cavity formed between the upper spray tray rotator 2 and the upper connection sleeve body 3. As shown in FIG. 2, the output end of the upper nozzle connection pipe has a horizontal 270-degree circular arc bend, and an output port is arranged on the 270-degree circular arc bend every 90 degrees and communicates with the circular-ring-shaped closed cavity formed between the upper spray tray rotator and the upper connection sleeve body. One internal nozzle 25 is arranged on the output port of each upper nozzle connection pipe 7 on the bottom surface of the upper connection sleeve body 3. The upper air pipe joints 5 and the upper lubricant pipe joints 6 are welded to the input ends of the upper nozzle connection pipes 7.

The lower spray tray rotator 10 is a circular hollow tube having a bottom surface, and a third through hole is formed in the middle of the bottom surface. A circle of second inner wall is arranged around the third through hole in the lower spray tray rotator 10, and the lower spray tray rotator 10 is integrally formed. The lower connection sleeve body 11 is fixed to the bottom surface of the spray tray main frame 8 by welding, and the lower connection sleeve body 11 is a circular hollow tube having a top surface. A fourth through hole is formed in the middle position of the top surface of the lower connection sleeve body 11. The lower spray tray rotator 10 is fastened in the lower connection sleeve body 11, and the second inner wall is fastened on the circumference of the fourth through hole. A circular-ring-shaped closed cavity is formed between the lower spray tray rotator 10 and the lower connection sleeve body 11. The sealing ring 20 is arranged between the inner side of the side wall of the lower connection sleeve body 11 and the outer side of the side wall of the lower spray tray rotator 10, and the sealing ring 20 is arranged between the second inner wall and the top surface of the lower connection sleeve body 11. The inner side of the side wall of the lower connection sleeve body 11 is provided with an inward circular-ring step, and the outer side of the side wall of the lower spray tray rotator 10 is provided with an outward circular-ring step. One third bearing 23 is arranged at a mutually fastened position of the step inside the lower connection sleeve body 11 and the step outside the lower spray tray rotator 10. One fourth bearing 24 is arranged between the second inner wall and the top surface of the lower connection sleeve body, and the fourth bearing 24 is embedded into the inner side of the second inner wall and arranged on the lower rotating shaft 12 in a sleeving manner. The lower external nozzles 9 are fixedly arranged on the bottom surface of the lower spray tray rotator 10 by welding, and the lower external nozzles 9 communicate with the circular-ring-shaped closed cavity formed between the lower spray tray rotator 10 and the lower connection sleeve body 11. The lower external nozzles 9 are arranged on the lower spray tray rotator 10. Every four of the lower external nozzles are distributed on one pitch circle, and all the lower external nozzles are distributed on three pitch circles. There are 12 lower external nozzles 9. The outer sides of center holes of the lower external nozzles 9 are conical, which facilitates the uniformity of lubricant spraying. The lower rotating shaft 12 passes through the third through hole in the lower spray tray rotator and the fourth through hole in the top surface of the lower connection sleeve body 11 and is connected to an output shaft of the lower rotating driving mechanism. The lower spray tray rotator 10 is fixed on the lower rotating shaft 12. One flange 19 is fixed at the bottom end of the lower rotating shaft 12, and the flange 19 on the bottom surface is fixed to the lower spray tray rotator 10 through the connection bolt 28. The flange 19 integrally connects the lower rotating shaft 12 with the lower spray tray rotator 10 into a whole for rotation through the connection bolt 28. The lower spray tray rotator 10 may rotate with the rotation of the lower rotating shaft 12. The lower rotating driving mechanism is fixed in a hollow cavity of the main body connection body 27 of the spray tray main frame 8 on the lower connection sleeve body 11. The lower rotating driving mechanism includes a servo motor 16, a speed reducer 17 and a coupling 18. An output shaft of the servo motor 16 is connected to the speed reducer 17. The output end of the speed reducer 17 is connected to the coupling 18, and the output end of the coupling 18 of the lower rotating driving mechanism passes through the through hole in the main body connection body 27 and is connected to the lower rotating shaft 12. Two lower nozzle connection pipes 15 are arranged on the spray tray main frame 8. The lower nozzle connection pipes 15 are fixed on the main body frame 26 by welding. The input end of each lower nozzle connection pipe 15 is connected to one lower air pipe joint 13 and one lower lubricant pipe joint 14, and the output end of the lower nozzle connection pipe 15 communicates with the top of the circular-ring-shaped closed cavity formed between the lower spray tray rotator 10 and the lower connection sleeve body 11. As shown in FIG. 3, the output end of the lower nozzle connection pipe has a horizontal 270-degree circular arc bend, and an output port is arranged on the 270-degree circular arc bend every 90 degrees and communicates with the circular-ring-shaped closed cavity formed between the lower spray tray rotator and the lower connection sleeve body. One internal nozzle 25 is also arranged on the output port of each lower nozzle connection pipe 15 on the top surface of the lower connection sleeve body 11. The lower air pipe joints 13 and the lower lubricant pipe joints 14 are welded to the input ends of the lower nozzle connection pipes 15. The upper air pipe joints 5 and the lower air pipe joints 13 are respectively welded with the upper lubricant pipe joints 6 and the lower lubricant pipe joints 14 into a whole to form four groups, and compressed air and a lubricant are mixed and enter the two upper nozzle connection pipes 7 and the two lower nozzle connection pipes 15.

Firstly, the spray tray main frame 8 is connected to a peripheral telescopic control arm of equipment to realize expansion and contraction of the device of the present disclosure at the middle position of the die. Then, each group of the upper air pipe joint 5 and upper lubricant pipe joint 6 are respectively connected to a compressed air pipe and a lubricant pressure tank in a workshop. Each group of the upper air pipe joint 5 and upper lubricant pipe joint 6 is connected to each pipe cavity of the upper nozzle connection pipe 7 and sprays the compressed air and the lubricant into the pipe cavity of the upper nozzle connection pipe 7, and the compressed air and lubricant mixture is sprayed into the closed cavity formed between the upper spray tray rotator 2 and the upper connection sleeve body 3 through the eight internal nozzles 25 and then is sprayed to an upper die through the upper external nozzles 1. Meanwhile, each group of the lower air pipe joint 13 and lower lubricant pipe joint 14 is respectively connected to the compressed air pipe and the lubricant pressure tank in the workshop. Each group of the lower air pipe joint 13 and lower lubricant pipe joint 14 is connected to each pipe cavity of the lower nozzle connection pipe 15 and sprays the compressed air and the lubricant into the pipe cavity of the lower nozzle connection pipe 15, and the compressed air and lubricant mixture is sprayed into the closed cavity formed between the lower spray tray rotator 10 and the lower connection sleeve body 11 through the eight internal nozzles 25 and then is sprayed to a lower die through the lower external nozzles 9. The servo motor 10 and the speed reducer 11 drive the upper rotating shaft 8 to rotate through the coupling 9 to drive the upper spray tray rotator 3 to rotate and spray the compressed air and lubricant mixture to the upper die through the external nozzles 1 (there are twelve external nozzles in total). The servo motor 16 and the speed reducer 17 of the upper rotating driving mechanism drive the upper rotating shaft 4 to rotate through the coupling 18, and the servo motor 16 and the speed reducer 17 of the lower rotating driving mechanism drive the lower spray tray rotator 10 to rotate through the coupling 18 and spray the compressed air and lubricant mixture to the lower die through twelve upper external nozzles 1 and twelve lower external nozzles 9, thereby respectively realizing that the same dosage of the lubricant is sprayed onto the surfaces of the maximum pitch circles of the upper and lower dies to achieve the objective of uniformly spraying a forging lubricant to the working surfaces of the upper and lower dies.

The upper air pipe joints 5 and the lower air pipe joints 13, and the upper lubricant pipe joints 6 and the lower lubricant pipe joints 14 are respectively connected to a compressed air valve body control pipeline and a lubricant valve body control pipeline. The upper air pipe joints 5 and the lower air pipe joints 13, and the upper lubricant pipe joints 6 and the lower lubricant pipe joints 14 are welded to the ends of the upper nozzle connection pipes 7 or the lower nozzle connection pipes 15. Four air pipe joints are respectively welded with four lubricant pipe joints to form four groups, and four groups of compressed air and lubricant mixtures are formed and enter the four nozzle connection pipes. The flow rates, flow velocities and pressures of the compressed air and the lubricant which flow into the respective pipe cavities are controlled by controlling the pipeline valve bodies, so as to spray the compressed air and lubricant mixture into a closed pipe cavity, and the speed and time of rotation of spindles of the servo motors are controlled to realize rotatable spraying of the upper nozzles to the working surface of the upper die and realize rotatable spraying of the lower nozzles to the working surface of the lower die, thereby realizing automatic control of the dosage of the lubricant on the working surface of the die, achieving the objective of uniformly spraying the forging lubricant and reducing the forging defects.

The present disclosure also includes a control unit. The PLC (Programmable Logic Controller) control unit controls the rotating speeds and rotating time of the servo motors, and controls the pipeline valve bodies to control the flow rates, the flow velocities and the pressures of the compressed air and the lubricant, thereby controlling and adjusting the dosages of the compressed air and the lubricant to automatically control the dosage of the lubricant sprayed onto the working surface of the die. The pipeline valve bodies of the compressed air and lubricant valve body control pipelines and the servo motors of the upper rotating driving mechanism and the lower rotating driving mechanism are all connected with the PLC control unit in a signal manner, and the PLC control unit controls the flow rates, the flow velocities and the pressures of the compressed air and the lubricant by controlling the pipeline valve bodies, and controls the rotating speeds and rotating time by controlling the servo motors, so as to control the amount of the lubricant sprayed to the surface of the die.

Embodiment 2

A difference between Embodiment 2 and Embodiment 1 is the number of circular-ring-shaped cavities formed between the top surface of the upper spray tray rotator and the bottom surface of the upper connection sleeve body. In Embodiment 2, a plurality of cylindrical connection inner walls are further arranged between the top surface of the upper spray tray rotator 2 and the bottom surface of the upper connection sleeve body 3, and divide the circular-ring-shaped closed cavity between the top surface of the upper spray tray rotator 2 and the bottom surface of the upper connection sleeve body 3 into a plurality of circular-ring-shaped closed cavities. Each circular-ring-shaped closed cavity communicates with the outside through the upper external nozzles 1, and is connected with one upper air pipe joint 5 and one upper lubricant pipe joint 6 through one upper nozzle connection pipe 7. A plurality of cylindrical connection inner walls are also arranged between the top surface of the lower connection sleeve body 11 and the bottom surface of the lower spray tray rotator 10, and divide the circular-ring-shaped closed cavity between the top surface of the lower connection sleeve body and the bottom surface of the lower spray tray rotator into a plurality of circular-ring-shaped closed cavities. Each circular-ring-shaped closed cavity communicates with the outside through the lower external nozzles 9, and is connected with one lower air pipe joint 13 and one lower lubricant pipe joint 14 through one lower nozzle connection pipe 15. The rest components and their connection relations and positions are all the same as in Embodiment 1.

Based on the above, the present disclosure provides the spray tray device capable of rotatably spraying the die lubricant, including the external nozzles, the spray tray rotators, the connection sleeve bodies, the rotating shafts, the rotating driving mechanisms, the air pipe joints, the lubricant pipe joints and the nozzle connection pipes. The rotating driving mechanisms drive the rotating shafts to rotate. The rotating shafts drive the spray tray rotators to rotate. The external nozzles are arranged on the spray tray rotators. The air pipe joints and the lubricant pipe joints respectively input the compressed air and the lubricant into the cavities, formed between the spray tray rotators and the connection sleeve bodies, through the nozzle connection pipes, and then the compressed air and the lubricant are sprayed out through the external nozzles. The device implements that the same dosage of the lubricant is sprayed into the surfaces of the maximum pitch circles of the upper and lower dies and achieves the objective of uniformly spraying the forging lubricant onto the working surfaces of the upper and lower dies to reduce the forging defects. In addition, the control unit of the device controls the flow rates, the flow velocities and the pressures of the compressed air and the lubricant by controlling the pipeline valve bodies, and controls the rotating speeds and rotating time by controlling the servo motors, so as to control the amount of the lubricant sprayed to the surface of the die, so that the automation degree of the equipment can be increased, and the production efficiency can be improved.

The embodiments of the application are described in detail above, particular examples are used herein to explain the principle and embodiments of the application, and the above description of the embodiments is only used to help understanding the methods and core concept of the application; and meanwhile, for those having ordinary skill in the art, according to the idea of the application, there will be changes in the specific implementation mode and application scope, in conclusion, the contents of the specification shall not be construed as a limitation of the application.

What is claimed is:

1. A spray tray device capable of rotatably spraying a die lubricant, comprising:

upper external nozzles; an upper spray tray rotator; an upper connection sleeve body; an upper rotating shaft; an upper rotating driving mechanism; upper air pipe joints; upper lubricant pipe joints; upper nozzle connection pipes; a spray tray main frame; lower external nozzles; a lower spray tray rotator; a lower connection sleeve body; a lower rotating shaft; a lower rotating driving mechanism; lower air pipe joints; lower lubricant pipe joints; and lower nozzle connection pipes, wherein, the upper spray tray rotator is a circular hollow tube having a top surface, and a first through hole is formed in the middle of the top surface; a circular first inner wall is arranged around the first through hole in the upper spray tray rotator, and the upper spray tray rotator is formed in one piece; the upper connection sleeve body is fixed to the top surface of the spray tray main frame, and the upper connection sleeve body is a circular hollow tube having a bottom surface; a second through hole is formed in the middle position of the bottom surface of the upper connection sleeve body; the upper spray tray rotator is fastened in the upper connection sleeve body, and the first inner wall is fastened on a circumference of the second through hole; a circular-ring-shaped closed cavity is formed between the upper spray tray rotator and the upper connection sleeve body; the upper external nozzles are arranged on the top surface of the upper spray tray rotator, and the upper external nozzles communicate with the circular-ring-shaped closed cavity formed between the upper spray tray rotator and the upper connection sleeve body; the upper rotating shaft passes through the first through hole in the upper spray tray rotator and the second through hole in the bottom surface of the upper connection sleeve body and is connected to an output shaft of the upper rotating driving mechanism; the upper spray tray rotator is fixed on the upper rotating shaft; the upper spray tray rotator may rotate with the rotation of the upper rotating shaft; the upper rotating driving mechanism is fixed in the spray tray main frame below the upper connection sleeve body; one or more upper nozzle connection pipes are arranged on the spray tray main frame, and an input end of each upper nozzle connection pipe is connected with one upper air pipe joint and one upper lubricant pipe joint, and an output end of each upper nozzle connection pipe communicate with the bottom of the circular-ring-shaped closed cavity formed between the upper spray tray rotator and the upper connection sleeve body; and the lower spray tray rotator is a circular hollow tube having a bottom surface, and a third through hole is formed in the middle of the bottom surface; a circular second inner wall is arranged around the third through hole in the lower spray tray rotator, and the lower spray tray rotator is formed in one piece; the lower connection sleeve body is fixed to the bottom surface of the spray tray main frame, and the lower connection sleeve body is a circular hollow tube having a top surface; a fourth through hole is formed in the middle position of the top surface of the lower connection sleeve body; the lower spray tray rotator is fastened in the lower connection sleeve body, and the second inner wall is fastened on a circumference of the fourth through hole;

a circular-ring-shaped closed cavity is formed between the lower spray tray rotator and the lower connection sleeve body; the lower external nozzles are arranged on the bottom surface of the lower spray tray rotator, and the lower external nozzles communicate with the circular-ring-shaped closed cavity formed between the lower spray tray rotator and the lower connection sleeve body; the lower rotating shaft passes through the third through hole in the lower spray tray rotator and the fourth through hole in the top surface of the lower connection sleeve body and is connected to an output shaft of the lower rotating driving mechanism; the lower spray tray rotator is fixed on the lower rotating shaft; the lower spray tray rotator may rotate with the rotation of the lower rotating shaft; the lower rotating driving mechanism is fixed in the spray tray main frame on the lower connection sleeve body; one or more lower nozzle connection pipes are arranged on the spray tray main frame, and an input end of each lower nozzle connection pipe is connected with one lower air pipe joint and one lower lubricant pipe joint, and an output end of the lower nozzle connection pipe communicates with the top of the circular-ring-shaped closed cavity formed between the lower spray tray rotator and the lower connection sleeve body.

2. The spray tray device capable of rotatably spraying a die lubricant according to claim 1, wherein a plurality of cylindrical connection inner walls are further arranged between the top surface of the upper spray tray rotator and the bottom surface of the upper connection sleeve body, and divide the circular-ring-shaped closed cavity between the top surface of the upper spray tray rotator and the bottom surface of the upper connection sleeve body into a plurality of circular-ring-shaped closed cavities; each circular-ring-shaped closed cavity communicates with the outside of the entire spray tray device through the upper external nozzles, and is connected with one upper air pipe joint and one upper lubricant pipe joint through one upper nozzle connection pipe; a plurality of cylindrical connection inner walls are also arranged between the top surface of the lower connection sleeve body and the bottom surface of the lower spray tray rotator, and divide the circular-ring-shaped closed cavity between the top surface of the lower connection sleeve body and the bottom surface of the lower spray tray rotator into a plurality of circular-ring-shaped closed cavities; each circular-ring-shaped closed cavity communicates with the outside of the entire spray tray device through the lower external nozzles, and is connected with one lower air pipe joint and one lower lubricant pipe joint through one lower nozzle connection pipe.

3. The spray tray device capable of rotatably spraying a die lubricant according to claim 1, wherein each of the upper rotating driving mechanism and the lower rotating driving mechanism comprises a servo motor, a speed reducer and a coupling; the servo motors are fixed in the spray tray main frame; output shafts of the servo motors are connected with the speed reducers; outputs of the speed reducers are connected with the couplings; the coupling of the upper rotating driving mechanism is connected with the upper rotating shaft; and the coupling of the lower rotating driving mechanism is connected with the lower rotating shaft.

4. The spray tray device capable of rotatably spraying a die lubricant according to claim 1, wherein the output end of the upper nozzle connection pipe has a horizontal 270-degree circular arc bend, and an output port is arranged on the 270-degree circular arc bend every 90 degrees and communicates with a circular-ring-shaped closed cavity formed between the upper spray tray rotator and the upper connection sleeve body; one internal nozzle is arranged on each of the output ports of the upper nozzle connection pipe on the bottom surface of the upper connection sleeve body; the output end of the lower nozzle connection pipe has a horizontal 270-degree circular arc bend, and an output port is arranged on the 270-degree circular arc bend every 90 degrees and communicates with the circular-ring-shaped closed cavity formed between the lower spray tray rotator and the lower connection sleeve body; and one internal nozzle is also arranged on each of the output ports of the lower nozzle connection pipe on the top surface of the lower connection sleeve body.

5. The spray tray device capable of rotatably spraying a die lubricant according to claim 1, wherein a first sealing ring is arranged between an inner side of a side wall of the upper connection sleeve body and an outer side of a side wall of the upper spray tray rotator, and a second sealing ring is arranged between the first inner wall and the bottom surface of the upper connection sleeve body; a third sealing ring is arranged between an inner side of a side wall of the lower connection sleeve body and an outer side of a side wall of the lower spray tray rotator, and a fourth sealing ring is arranged between the second inner wall and the top surface of the lower connection sleeve body.

6. The spray tray device capable of rotatably spraying a die lubricant according to claim 1, wherein an inner side of a side wall of the upper connection sleeve body is provided with an inward circular-ring step, and an outer side of a side wall of the upper spray tray rotator is provided with an outward circular-ring step; one first bearing is arranged at a mutually fastened position of the step inside the upper connection sleeve body and the step outside the upper spray tray rotator; one second bearing is arranged between the first inner wall and the bottom surface of the upper connection sleeve body, and the second bearing is embedded into the inner side of the first inner wall and arranged on the upper rotating shaft in a sleeving manner; an inner side of a side wall of the lower connection sleeve body is provided with an inward circular-ring step, and an outer side of a side wall of the lower spray tray rotator is provided with an outward circular-ring step; one third bearing is arranged at a mutually fastened position of the step inside the lower connection sleeve body and the step outside the lower spray tray rotator; one fourth bearing is arranged between the second inner wall and the top surface of the lower connection sleeve body, and the fourth bearing is embedded into the inner side of the second inner wall and arranged on the lower rotating shaft in a sleeving manner.

7. The spray tray device capable of rotatably spraying a die lubricant according to claim 1, wherein the upper external nozzles are arranged on the upper spray tray rotator; every four of the upper external nozzles are distributed on one pitch circle, and all the upper external nozzles are distributed on three pitch circles; the lower external nozzles are arranged on the lower spray tray rotator; every four of the lower external nozzles are distributed on one pitch circle, and all the lower external nozzles are distributed on three pitch circles; the outer sides of the center holes of the upper external nozzles and the lower external nozzles are conical, which facilitates the uniformity of lubricant spraying.

8. The spray tray device capable of rotatably spraying a die lubricant according to claim 1, wherein one flange is fixed at each of the top end of the upper rotating shaft and the bottom end of the lower rotating shaft; the flange on the top surface is fixed on the upper spray tray rotator, and the flange on the bottom surface is fixed on the lower spray tray rotator.

9. The spray tray device capable of rotatably spraying a die lubricant according to claim 1, wherein the spray tray main frame comprises a main frame body and a main connection body; the main frame body is located between the upper connection sleeve body and the lower connection sleeve body; upper nozzle connection pipes and lower nozzle connection pipes are fixed on the main frame body; the main connection body horizontally passes through the main frame body from a middle part; the main connection body is of a hollow tubular structure; the upper rotating driving mechanism and the lower rotating driving mechanism are fixed in a hollow cavity of the main connection body; and output ends of the upper rotating driving mechanism and the lower rotating driving mechanism respectively pass through a through hole in the main connection body and are connected to the upper rotating shaft and the lower rotating shaft.

10. The spray tray device capable of rotatably spraying a die lubricant according to claim 1, wherein the upper air pipe joints and the lower air pipe joints are connected to a compressed air valve body control pipeline; the upper lubricant pipe joints and the lower lubricant pipe joints are connected to a lubricant valve body control pipeline; the device also comprises a control unit; the control unit is connected with pipeline valve bodies of the compressed air valve body control pipeline and the lubricant valve body control pipeline and servo motors in the upper rotating driving mechanism and the lower rotating driving mechanism in a signal manner; the control unit controls the flow rates, the flow velocities and the pressures of the compressed air and the lubricant by controlling the pipeline valve bodies, and controls the rotating speed and rotating time by controlling the servo motors, so as to control the amount of the lubricant sprayed to the surface of the die.

* * * * *